US010889118B2

(12) United States Patent
Tarrida Tirado et al.

(10) Patent No.: US 10,889,118 B2
(45) Date of Patent: Jan. 12, 2021

(54) WIPER BLADE POSITIONS

(71) Applicant: HEWLETT-PACKARD DEVELOPMENT COMPANY, L.P., Spring, TX (US)

(72) Inventors: Francesc Tarrida Tirado, Sant Cugat del Valles (ES); Sara Molins Cabani, Sant Cugat del Valles (ES); Xavier Gasso Puchal, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/487,170

(22) PCT Filed: Jun. 13, 2017

(86) PCT No.: PCT/US2017/037217
§ 371 (c)(1),
(2) Date: Aug. 20, 2019

(87) PCT Pub. No.: WO2018/231205
PCT Pub. Date: Dec. 20, 2018

(65) Prior Publication Data

US 2020/0055316 A1 Feb. 20, 2020

(51) Int. Cl.

| | |
|---|---|
| ***B41J 2/165*** | (2006.01) |
| ***B08B 1/00*** | (2006.01) |
| ***B08B 1/02*** | (2006.01) |

(52) U.S. Cl.
CPC ..... *B41J 2/16538* (2013.01); *B08B 1/006* (2013.01); *B08B 1/02* (2013.01); *B41J 2/16544* (2013.01); *B41J 2002/1655* (2013.01); *B41J 2002/16558* (2013.01)

(58) Field of Classification Search
CPC ..... B41J 2/16535; B41J 2/16538; B41J 2/16541; B41J 2/16544; B41J 2/16552; B41J 2/16588; B41J 2002/1655; B41J 2002/16558; B08B 1/005; B08B 1/006; B08B 1/02; B08B 3/02
See application file for complete search history.

(56) References Cited

U.S. PATENT DOCUMENTS

| | | | |
|---|---|---|---|
| 5,115,250 | A | 5/1992 | Harmon et al. |
| 5,806,994 | A | 9/1998 | Coffy et al. |
| 5,907,335 | A | 5/1999 | Johnson et al. |
| 6,530,642 | B1 | 3/2003 | Uchitata et al. |

(Continued)

FOREIGN PATENT DOCUMENTS

| | | |
|---|---|---|
| CN | 2820541 | 9/2006 |
| CN | 102259494 | 11/2011 |

(Continued)

*Primary Examiner* — Anh T Vo
(74) *Attorney, Agent, or Firm* — HP Inc. Patent Department

(57) ABSTRACT

In an example, a wiper system includes a first wiper blade, a second wiper blade, and a cam. In that example, the cam is coupled to the first wiper blade to move the first wiper blade to a first wipe position when the cam is in a first cam position and coupled to the second wiper blade to move the second wiper blade to a second wipe position when the cam is in a second cam position.

19 Claims, 11 Drawing Sheets

(56) References Cited

U.S. PATENT DOCUMENTS

| | | | | |
|---|---|---|---|---|
| 6,601,943 | B2 * | 8/2003 | Barinaga | B41J 2/16538 347/33 |
| 6,655,781 | B2 | 12/2003 | Nakagawa et al. | |
| 6,679,579 | B1 | 1/2004 | Tee et al. | |
| 6,764,161 | B1 | 7/2004 | Nakagawa et al. | |
| 6,913,338 | B2 * | 7/2005 | Rhoads | B41J 2/16538 347/28 |
| 7,159,962 | B2 | 1/2007 | Wouters | |
| 7,993,466 | B2 | 8/2011 | Aude | |
| 8,733,889 | B2 | 5/2014 | Uemura | |
| 9,469,112 | B2 * | 10/2016 | Berrios | B41J 2/16538 |
| 2007/0188545 | A1 * | 8/2007 | Miyamoto | B41J 2/16585 347/33 |
| 2008/0024550 | A1 * | 1/2008 | Miyazawa | B41J 2/16547 347/33 |
| 2008/0266342 | A1 | 10/2008 | Steinfield et al. | |
| 2010/0315463 | A1 | 12/2010 | Escude et al. | |
| 2011/0292126 | A1 | 12/2011 | Nystrom et al. | |
| 2011/0310171 | A1 | 12/2011 | Supron et al. | |
| 2013/0002756 | A1 | 1/2013 | Kriz | |
| 2013/0016158 | A1 * | 1/2013 | Ikeda | B41J 2/16538 347/33 |
| 2016/0101626 | A1 | 4/2016 | Kobayashi | |
| 2017/0015101 | A1 | 1/2017 | Coma Vives et al. | |

FOREIGN PATENT DOCUMENTS

| | | | |
|---|---|---|---|
| CN | 102407670 | | 4/2012 |
| CN | 104908430 | | 9/2015 |
| EP | 0913262 | A1 | 5/1999 |
| EP | 1310367 | A1 | 5/2003 |
| JP | 10138502 | | 5/1998 |
| JP | 2000190512 | | 7/2000 |
| JP | 2005118672 | | 5/2005 |
| JP | 2010012739 | | 1/2010 |
| JP | 2011067985 | | 4/2011 |
| JP | 2012051132 | | 3/2012 |

* cited by examiner

WIPER BLADE POSITIONS

BACKGROUND

Images are processed for use with computing machines, such as a print apparatus. A print apparatus, for example, may use control data based on processed image data to reproduce a physical representation of an image by operating a print fluid ejection system according to the control data. Components of a print apparatus, such as a fluid ejection device, may be serviced to improve print quality and/or the life of the component, for example. Some print apparatus include a mechanism, such as a service station, to perform various service routines.

DETAILED DESCRIPTION

Figure 1:
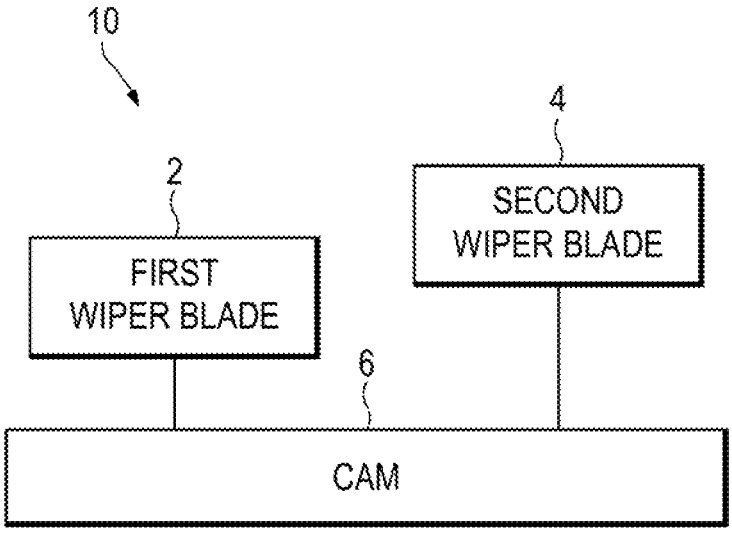
FIG. 1 is a block diagram depicting an example wiper system.

In the following description and figures, some example implementations of print apparatus, service station systems, and/or methods of operating blades of a wiper system. In examples described herein, a "print apparatus" may be a device to print content on a physical medium (e.g., paper, textile, a layer of powder-based build material, etc.) with a print material (e.g., ink or toner). For example, the print apparatus may be a wide-format print apparatus that prints latex-based print fluid on a print medium, such as a print medium that is size A2 or larger. The physical medium may printed on from sheets or a web roll. In the case of printing on a layer of powder-based build material, the print apparatus may utilize the deposition of print materials in a layer-wise additive manufacturing process. A print apparatus may utilize suitable print consumables, such as ink, toner, fluids or powders, or other raw materials for printing. In some examples, a print apparatus may be a three-dimensional (3D) print apparatus. An example of fluid print material is a water-based latex ink ejectable from a print head, such as a piezoelectric print head or a thermal inkjet print head. Other examples of print fluid may include dye-based color inks, pigment-based inks, solvents, gloss enhancers, fixer agents, and the like.

A print apparatus may include a service station to perform service routines on a component of the print apparatus. For example, a service station may include a wiping system and/or scraping system to remove excess print fluid from the fluid ejection device of the print apparatus. A service station may include a web material to use for wiping the fluid ejection device. The web material may be a consumable that moves used web material out of the way and moves unused web material to use for the subsequent service routine. The web material may be a textile, such as cloth, or made of other material appropriate for wiping a component of the print apparatus. Example textile web material of the service station may be woven fabric, non-woven fabric, fabric with synthetic layers, and the like. The cloth may be impregnated with a cleaning liquid or substantially dry (e.g., without liquid impregnated into the cloth).

The surface of a print head may have different types of serviceable issues. For example, excess print fluid may be wiped from the nozzle plate easier than solidified print substance (e.g., crusting). Various examples described below relate to providing different wiping operations that focus on performing characteristically different issues. A plurality of wipers are implemented on the service station to provide different amounts of force and/or other wiping characteristics. In this manner, the amount of force on the cloth may be adjusted to take care of different types of vice issues using a wiper system, for example.

The terms "include," "have," and variations thereof, as used herein, mean the same as the term "comprise" or appropriate variation thereof. Furthermore, the term "based on," as used herein, means "based at least in part on." Thus, a feature that is described as based on some stimulus may be based only on the stimulus or a combination of stimuli including the stimulus.

FIG. 1 is a block diagram depicting an example wiper system 10. The wiper system 10 generally includes a first wiper blade 2, a second wiper blade 4, and a cam 6 coupled to the first wiper blade 2 and the second wiper blade 4. The cam 6 is to move the first wiper blade 2 to a first wiper position when the cam 6 is in a first cam position and to move the second wiper blade 2 to a second wipe position when the cam 6 is in a second cam position. The first wiper blade 2 and the second wiper blade 4 may be raiseable to different heights for performing a service operation on a print head. For example, the first wipe position corresponding to the service position of a first wiper blade and the second wipe position corresponding to the service position of a second wiper blade are different interference heights (with reference to a print head carriage holding a print head to be wiped and/or with reference to a rest position of the cloth) that apply different force amounts on the cloth covering the first wiper blade and the second wiper blade (e.g., perpendicular force on the cloth with respect to the media advance to divert the cloth advance path). For example, the second wiper blade may be in a position higher than the first wiper blade during a service operation. In this manner, each wiper blade may divert the cloth towards a position of the print head carriage to a different amount based on the calibrated height of each wiper blade. The first and second wiper blades may be oriented parallel to each other at a wiping area.

The first wiper blade and the second wiper blade may be made of different materials with different compression attributes. For example, the first wiper blade 2 may be made of a silicone rubber composite and the second wiper blade 4 may be made of a plastic. The first wiper blade and the second wiper blade may a combination of shape, thickness, and material that produces linear deformation. For example, the blade may have a diamond shape with walls of a certain thickness of flexible material to allow for distributed compression along the length of the blade. Example compression amounts may be 2.5 mm when applying 12 newtons or 4 mm when applying 20 newtons, for example. The blade may be extruded with reference to the length of the blade to assist in substantial linear deformation upon receiving a compression force on the blade. The length of the blade may span substantially across the width of the cloth and may be substantially the same length of the cloth width.

Figure 2:
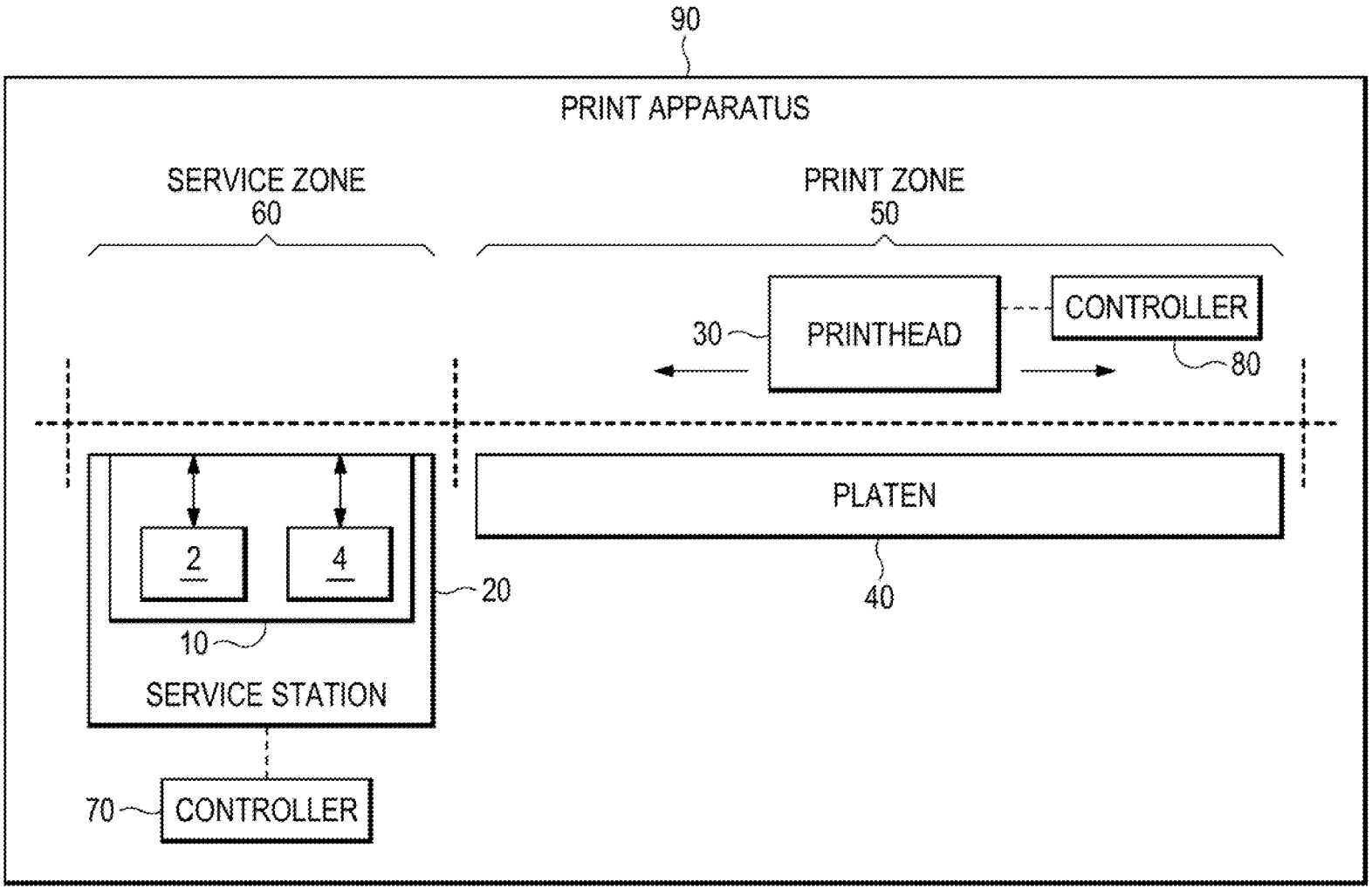
FIG. 2 is a block diagram of an example print apparatus.

FIG. 2 is a block diagram of an example print apparatus 90 having an example service station 20 with a wiper system 10 having multiple wiper blades 2 and 4 with adjustable heights. The blades 2 and 4 may be moved to different heights as operated by a controller 70. For example, the controller 70 coupled to the service station 20 may control rotation of a cam, using a motor and gear system, to an angle based on a print head scanning operation location (e.g., whether the print head carriage is inside or outside a print zone 50, the direction of movement of the print head carriage, etc.).

Another controller 80 may operate movement of a print head 30 used to eject print fluid on media passing along a platen 40. The print head scans or is otherwise moveable between a print zone 50 of the print apparatus and a service zone 60. The print zone 50 includes the area where media is printed on between the platen and lateral scanning positions of the print head 30 over the platen 30. The service zone 60 includes the area between the service station 20 and the lateral scanning positions of the print head 30 over the service station 20. As discussed further herein, in particular with reference to FIGS. 13 and 14, the height of the wiper blades may be synchronized with movement of the carriage holding the print head 30.

Figure 3:
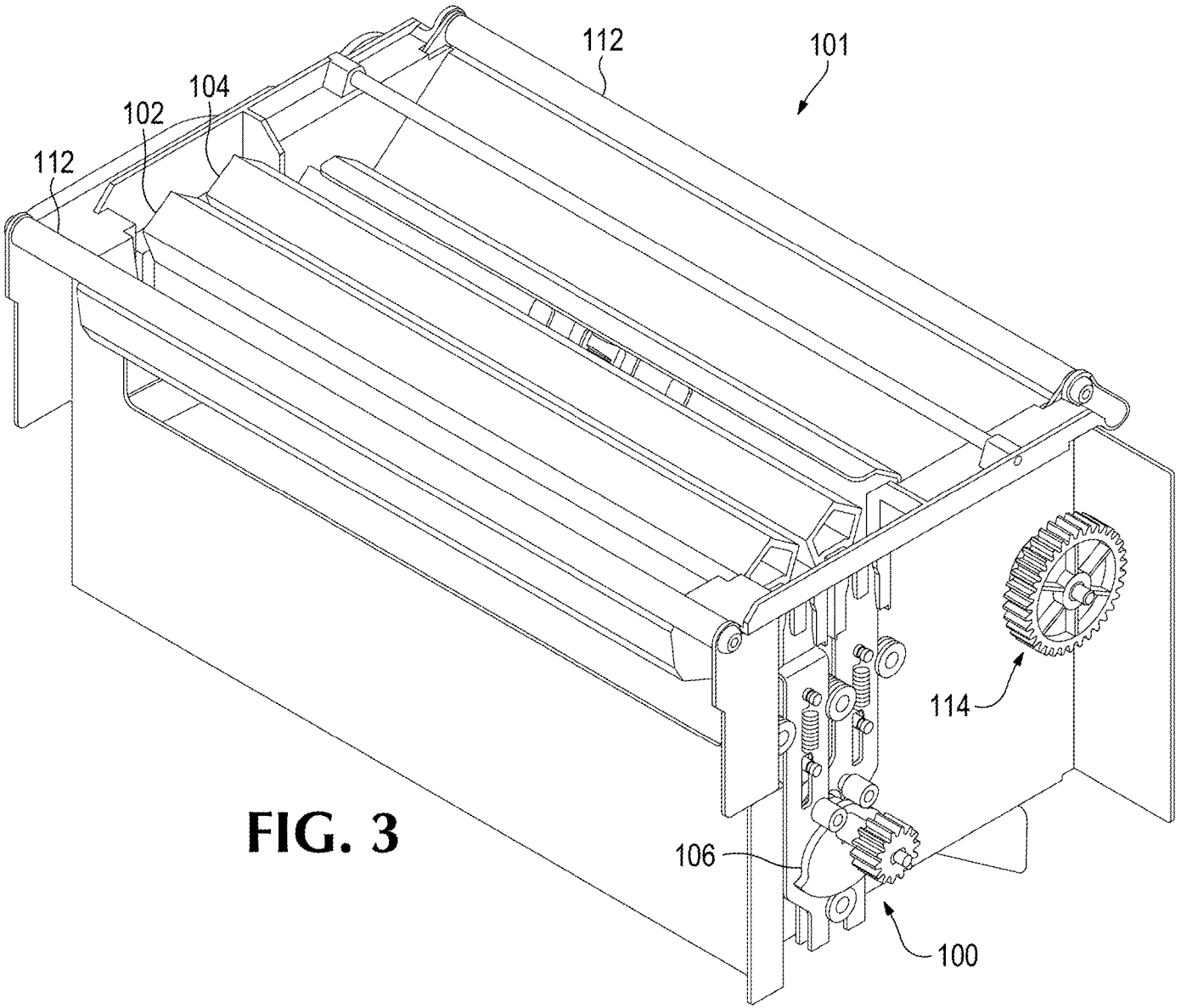
FIG. 3 depicts an example service station.

FIG. 3 depicts an example service station 101. The example service station 101 generally includes a wiper system 100 and a cloth advance mechanism 114. The wiper system 100 includes a first wiper blade 102, a second wiper blade 104, and a cam 106. The cloth advance mechanism 114 that advances cleaning cloth along a path defined by bars 112 using media handling components such as driven wheels, gears, pinch wheels, etc. The cloth advance mechanism 112 is able to advance the cloth over the first wiper blade 102 and second wiper blades 104 (e.g., a cloth wiping area) where the blades can press against the cloth to position the cloth to clean a print head with a particular amount of force.

FIGS. 4-7 are isometric views depicting example states of an example wiper system 100. The wiper system 100 generally includes a first wiper blade 102 and a second wiper blade 104 that are adjustable in position based on orientation of the cam 106. The cam 106 may be rigidly coupled to a shaft 118 having a corresponding cam 116 at a distal end of the shaft 118 (where the corresponding cam 116 is distal with reference to the location of the cam 106 with respect to the shaft 118). The cams 106 and 116 are rotatable to angles that correspond to different cam positions, such as a first cam position corresponding to placing a first wiper blade in a service position (e.g., a lifted position), a second cam position corresponding to placing a second wiper blade in a service position (e.g., a lifted position), and a third cam position where both the first wiper blade and the second wiper blade 104 are in a rest position (e.g., a down position).

Figure 4:
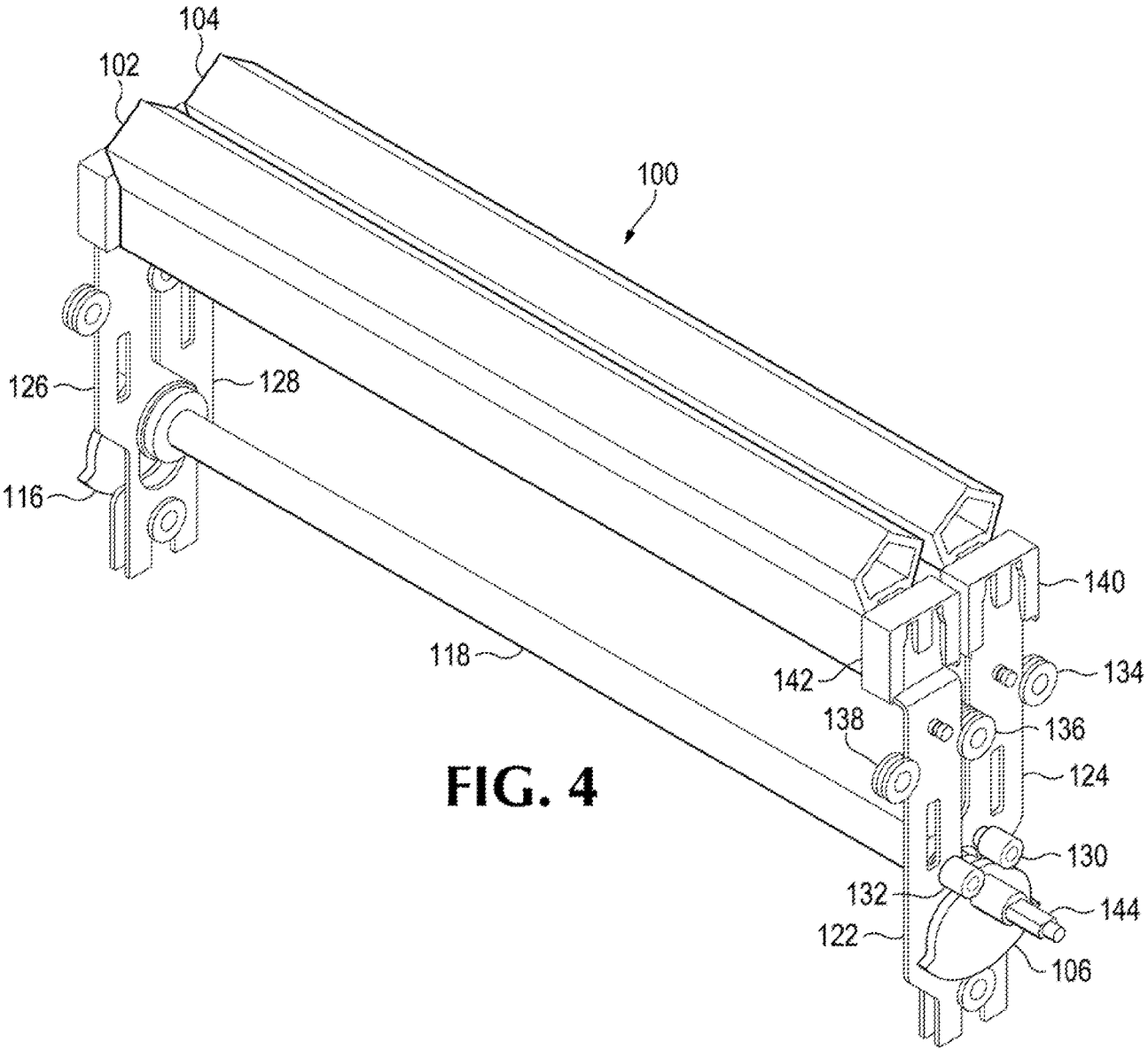
FIGS. 4-7 are isometric views depicting example states of an example wiper system.
Figure 5:
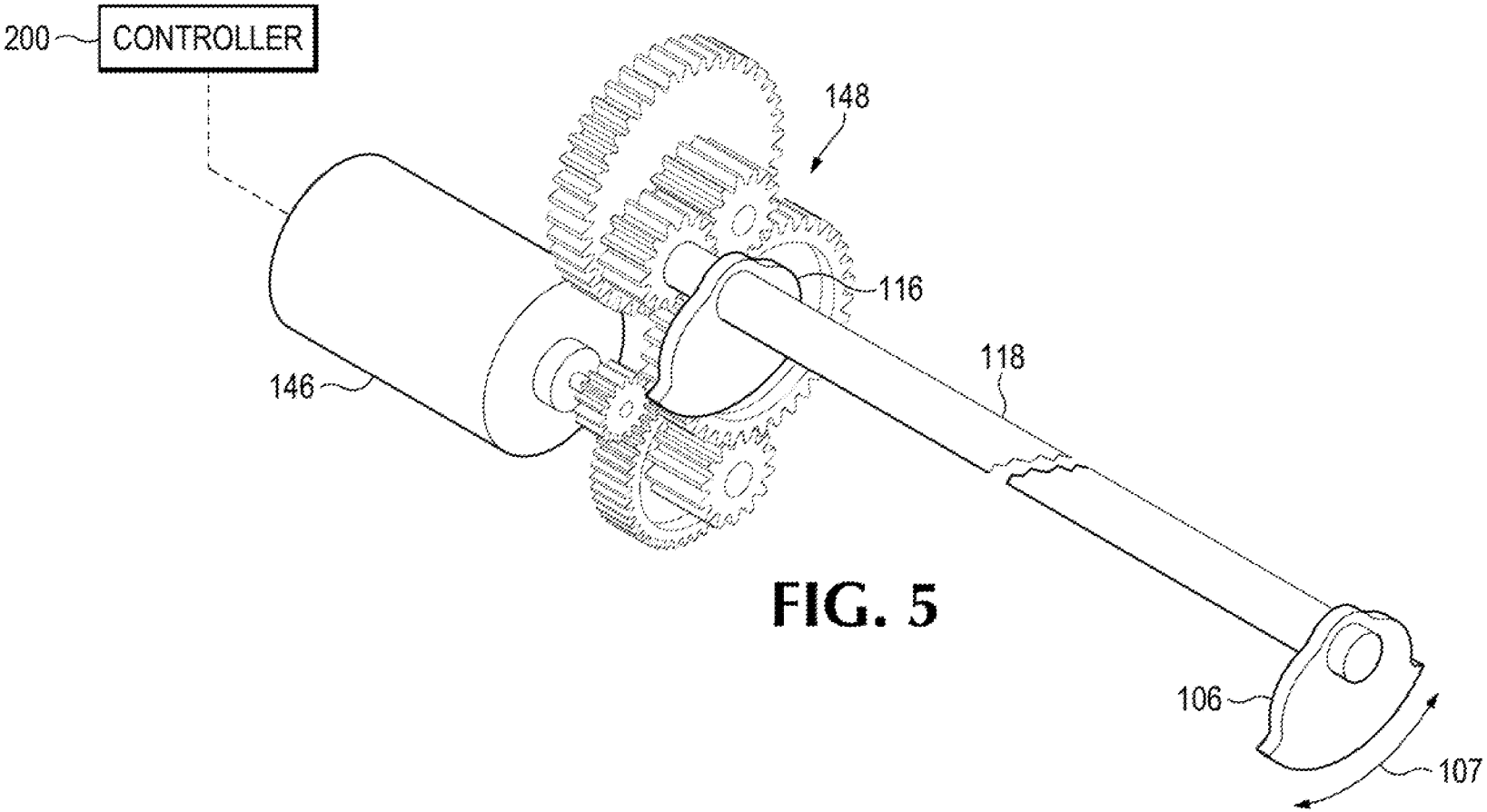

In the example of FIGS. 4-7, the cams 106 and 116 are coupled by a shaft 118 so that the cams 106 and 116 rotate at the same time. The shaft 118 may be rotatable via a connector end 144 that may be connectable to an adjustable transmission force, such as a motor. For example, FIG. 5 depicts the shaft 118 coupled to a motor 146 via a gear system 148 such that the cams 106 and 116 that are fixedly coupled to the shaft 118 rotate together as the shaft 118 rotates. In that example, the motor 146 may be encoded to rotate the cams 106 and 116 to angles corresponding to the first cam, position that lifts the first wiper blade and the second cam position that lifts the second wiper blade. Also with reference to FIG. 5, the motor 146 may be operated based on instructions executed by a controller 200. For example, a controller coupled to the motor may control rotation of the cam to an angle based on power output of the motor. The controller 200 is discussed further with reference to FIG. 12.

The cams 106 and 116 are shaped to generate movement of the blades 102 and 104 via the plates 122, 124, 126, and 128. In the example of FIG. 5, the shape of cam 106 includes recesses to catch pegs, such as peg 130 of FIG. 6 and peg 132 of FIG. 7. Other examples may include other cam shapes that induce wiper blade positioning, for example the cam may have edges shaped with different distances from a center of rotation of the cam to induce a movement corresponding to the distances as the cam rotates.

Figure 6:
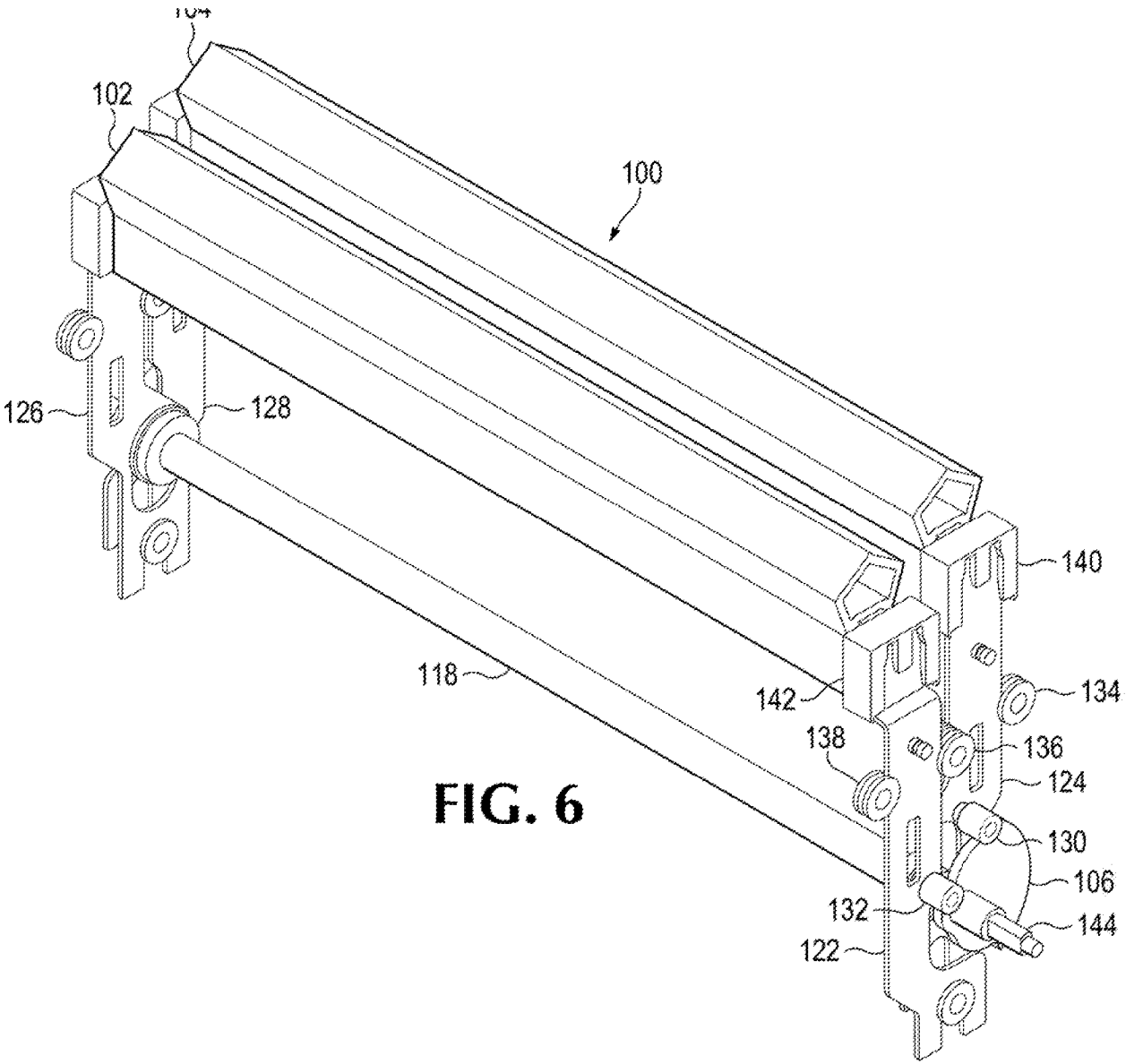
Figure 7:
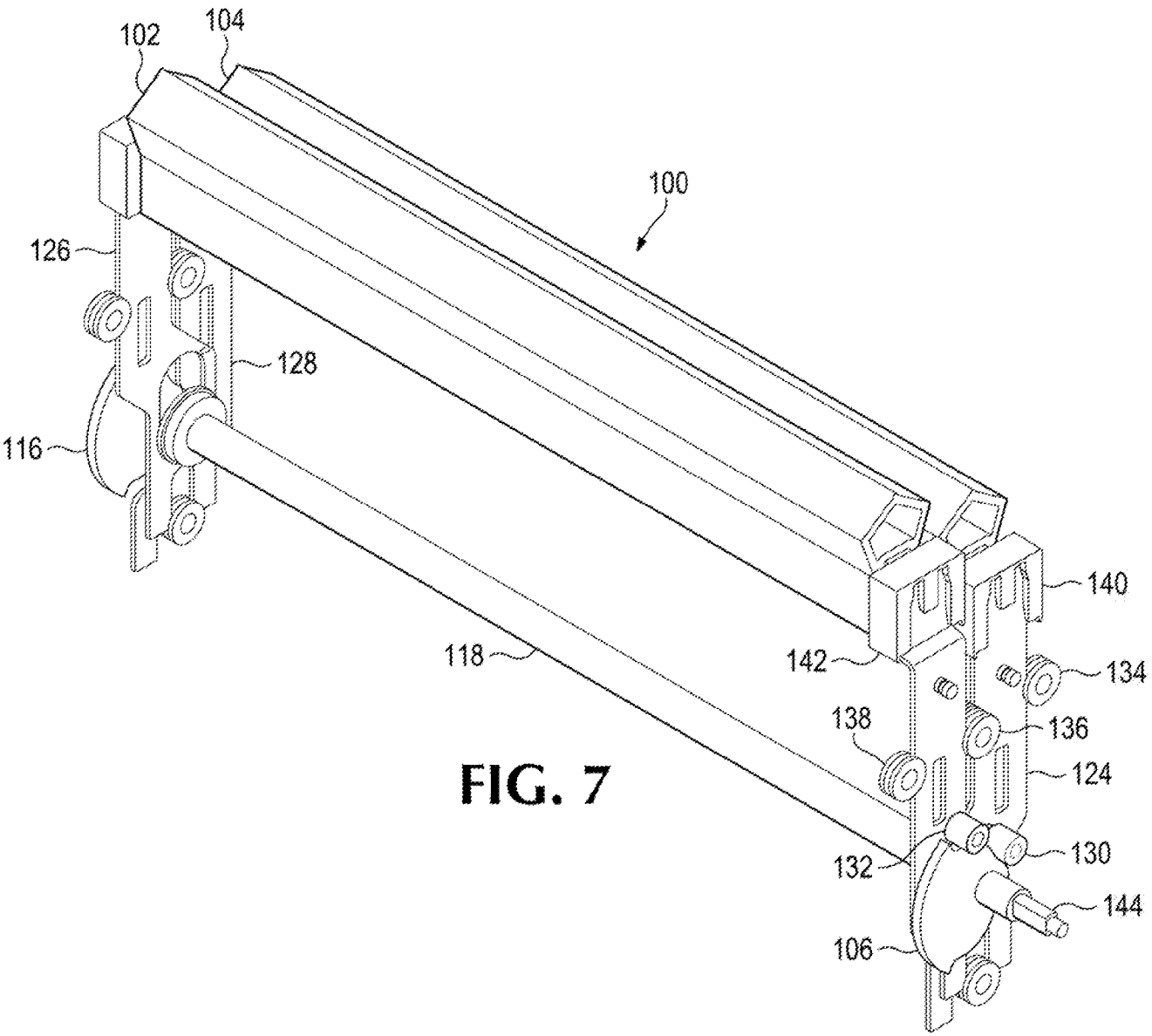

As the cams 106 and 116 rotate (as shown by directional arrow 107), plates 122, 124, 126, and 128 may shift the positions of the wiper blades 102 and 104. For example, a first set of plates coupled to the first wiper blade move the first wiper blade to the first wiper position when the cam is rotated to an angle corresponding to the first cam position and a second set of plates move the second wiper blade to the second wiper position when the cam is rotated to an angle corresponding to the second cam position. The amount of lift of a blade may have a linear relationship with an angle of the cam 106. Examples of cam positions are shown in FIGS. 4, 6, and 7. Referring to FIG. 4, the first wiper blade 102 and the second wiper blade 104 are in a rest position where both blades 102 and 104 are not extended (e.g., do not place force on cloth of the service station). Referring to FIGS. 6 and 7, the cams 106 and 116 are rotatable into positions (e.g., to an angle) to lift a blade 102 or the other blade 104 to a selected height.

Referring to FIG. 6, the cam 106 is rotated to a cam position that moves a peg 130 coupled to the plate 124. The plate 124 moves as the peg 130 is moved based on contact with the cam 106 during rotation and guides 134 and 136. The wiper blade 104 is coupled to the plate 124 by a connector 140 such that as the plate 124 moves away from the cam 106, the wiper blade 104 moves in the same direction. In the example of FIG. 6, the blade 104 is in a service position (e.g., extended to place a diverting force on cloth of the service station) while blade 102 is in a rest position (e.g., not extended).

Referring to FIG. 7, the cam 106 is rotated to a cam position that moves a peg 132 coupled to the plate 122. The plate 122 moves as the peg 132 is moved based on contact with the cam 106 during rotation and guides 136 and 138. The wiper blade 102 is coupled to the plate 122 by a connector 142 such that as the plate 122 moves away from the cam 106, the wiper blade 102 moves in the same direction. In the example of FIG. 7, blade 102 is in a service position (e.g., extended to place a diverting force on cloth of the service station) while blade 104 is in a rest position (e.g., not extended).

Figure 8:
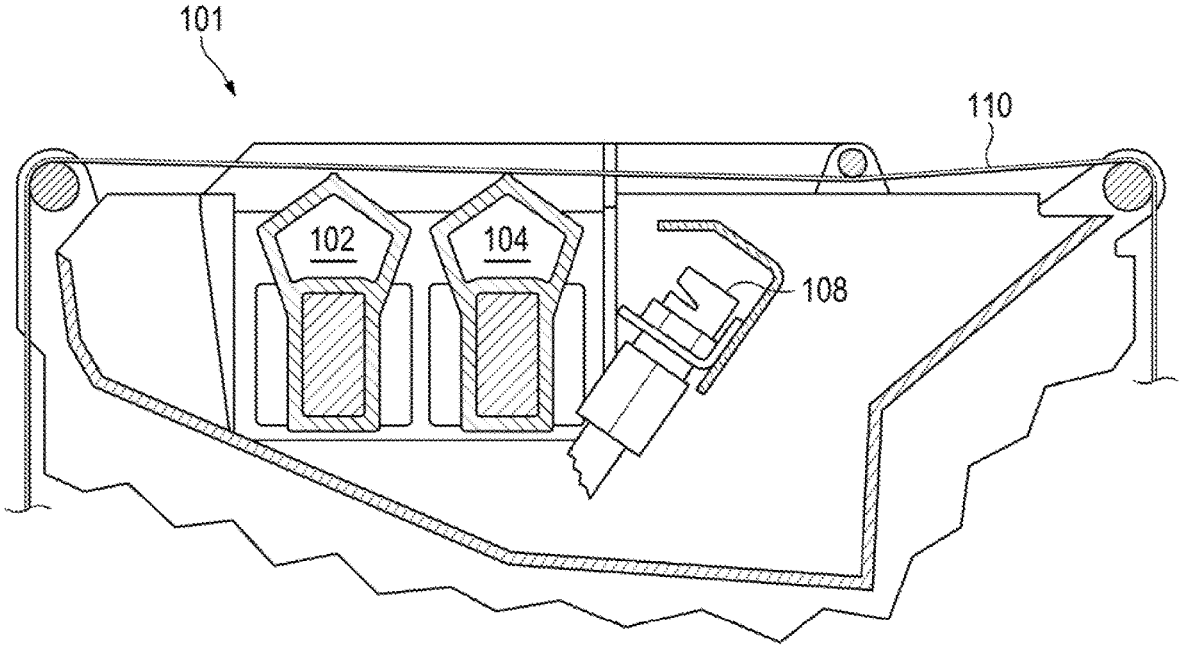
FIGS. 8-11 are side views depicting example states of an example wiper system.
Figure 9:
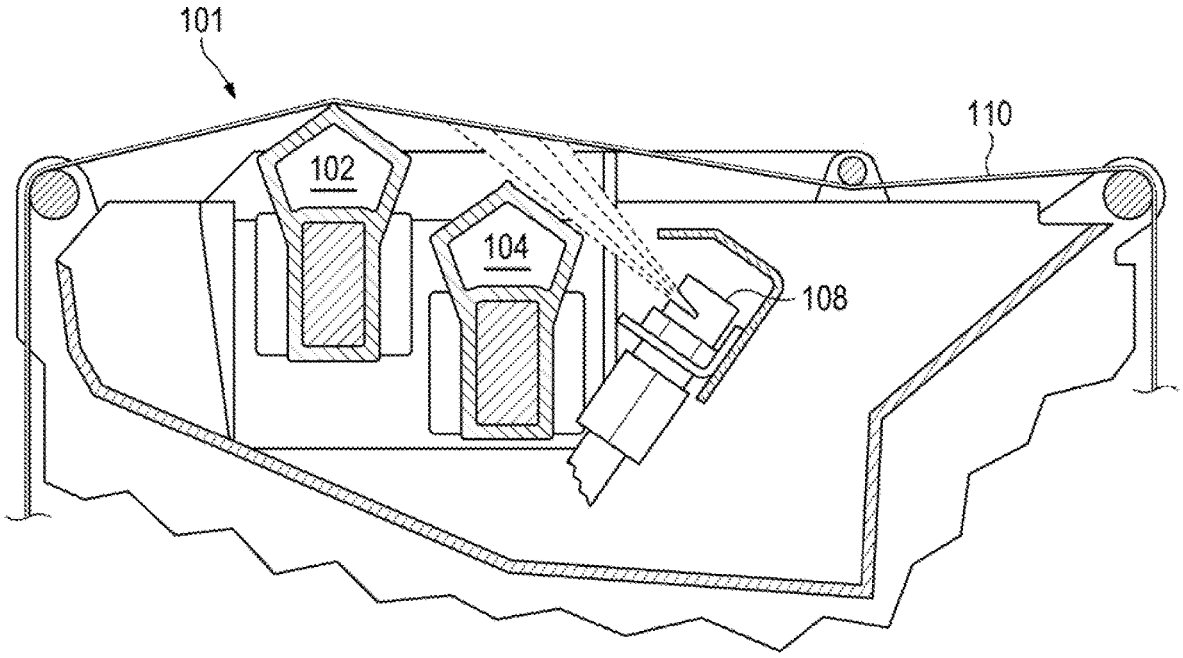

FIGS. 8-11 are side views depicting example states of an example service station 101. Referring to FIG. 8, wiper blades 102 and 104 are in rest positions where no additional force is placed on the cloth 110 by the wiper blades 102 and 104. Referring to FIG. 9, the wiper blade 102 is moved to an extended, service position that places force on the cloth 110 (e.g., a force perpendicular to the direction of cloth advance when the wiper blades are in the rest position of FIG. 8) and moves the cloth 110 away from the wiper blade 104. This allows for a first type of service operation to be performed, such as ejecting cleaning liquid onto the cloth from a liquid dispenser 108.

Figure 10:
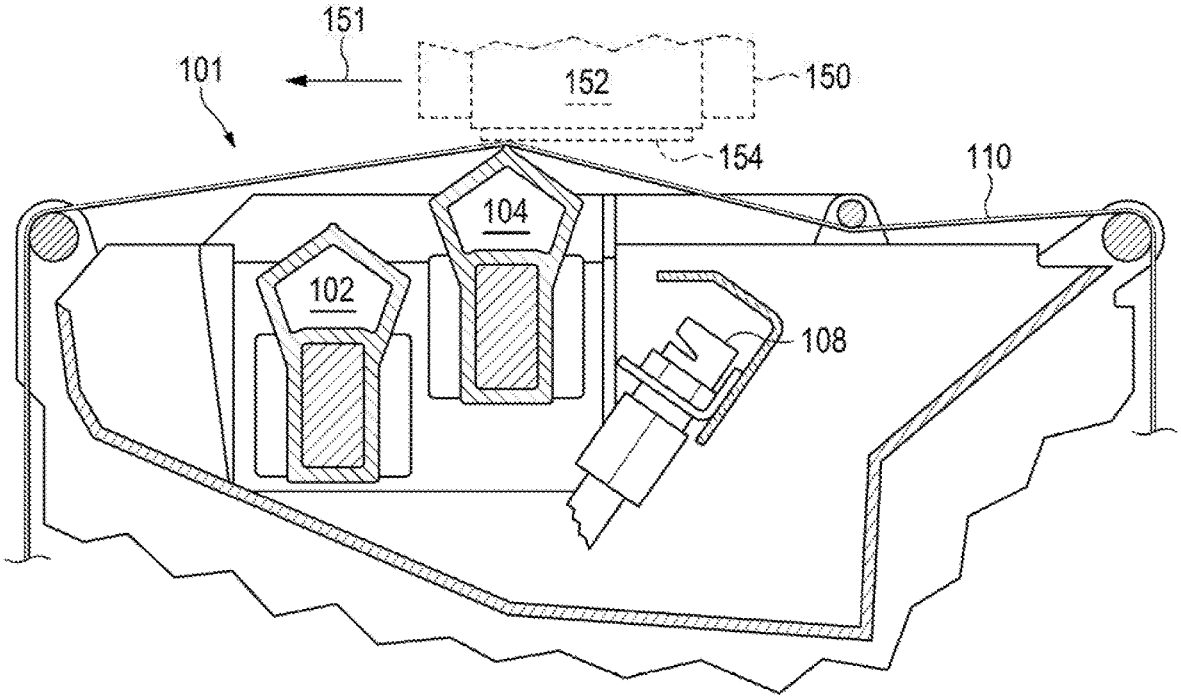

Referring to FIG. 10, the wiper blade 102 is moved back to a rest position and the wiper blade 104 is moved to an extended, service position that places force on the cloth 110 (e.g., a force perpendicular to the direction of cloth advance when the wiper blades are in the rest position of FIG. 8) and moves the cloth 110 away from the wiper blade 102. This allows for a second type of service operation to be performed where a print head carriage 150 moves in a first direction (represented by arrow 151). For example, the print head carriage 150 is controlled to move the print head 152 out of a print zone and into a service zone to allow a nozzle plate 154 to be cleaned by the cloth 100 by a first force based on the height of the wiper 104 with respect to the print head carriage 150. Note that in that example, the cloth area that was sprayed by the liquid dispenser 108 as shown in FIG. 9 may be used to make contact against the nozzle plate 154 (e.g., wipe a print head surface with a wet wipe service operation).

Figure 11:
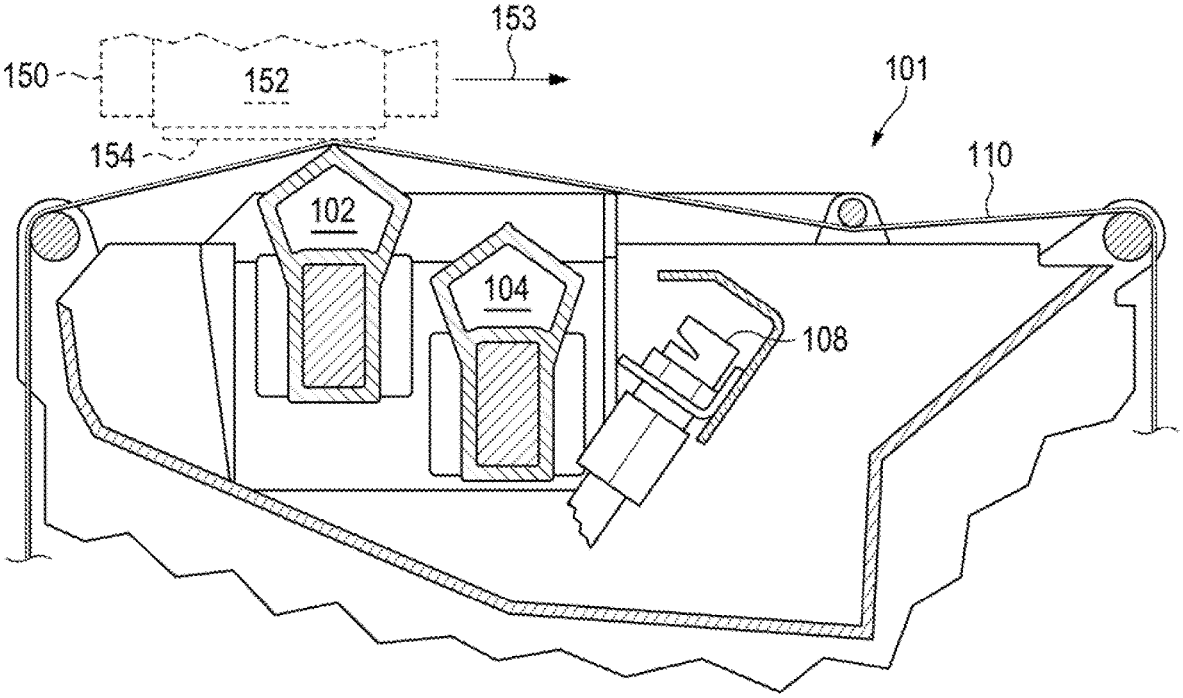

Referring to FIG. 11, the wiper blade 104 is moved back to a rest position and the wiper blade 102 is moved to an extended, service position that places force on the cloth 110 and moves the cloth 110 away from the wiper blade 104. This allows for a third type of service operation to be performed where a print head carriage 150 moves in a first direction (represented by arrow 153). For example, the print head carriage 150 is controlled to move the print head 152 from the service zone towards the print zone to allow a nozzle plate 154 to be cleaned by the cloth 110 by a second force based on the height of the wiper 102 with respect to the print head carriage 150. Note that in that example, a cloth area that was not sprayed by the liquid dispenser 108 may be used to place against the nozzle plate 154 (e.g., wipe a print head surface with a dry wipe service operation). In this manner, different combination of attributes of the service station components are used to provide different wiping operations on the service station which may allow for removal of different types of print fluid, for example, using a single service station to remove print fluid that is stuck of various degrees to the print head surface.

Figure 12:
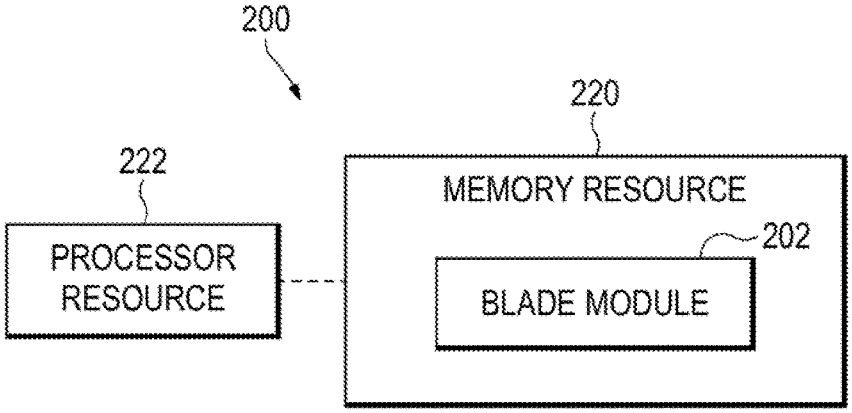
FIG. 12 is a block diagram depicting an example controller or a wiper system.

The positions of the blades in example states 8-11 and example service operations discussed herein may be operated by a controller. Referring to FIG. 12, a controller 200 for operating a service station may include a processor resources 222 and a memory resource 220. The memory resource 220 may contain a set of instructions that are executable by the processor resource 222. An example set of instructions include a blade module 202. The set of instructions 202 are operable to cause the processor resource 222 to perform operations of the system 100 when the set of instructions are executed by the processor resource 222. The processor resource 222 may carry out a set of instructions 202 to, for example, cause a cam to rotate to move a first wiper blade to a servicing position during a first service operation and cause the cam to rotate to move a second wiper blade to servicing position during a second service operation. For another example, the processor resource 222 may carry out a set of instructions to cause a first wiper blade of a service station to be in a service positon to place force on a wiping cloth when a print head carriage of a print apparatus is moving away from a print zone of the print apparatus, cause the first wiper blade to be in a rest position when the print head carriage is moving towards the print zone, and cause a second wiper blade of the service station to be in a service position when the print head carriage is moving towards the print zone. For yet another example, the processor resource 222 may carry out a set of instructions to select different blade pressures independently at each pass of a print head carriage, advance wiping cloth before a first wiper blade moves into a service position, apply an amount of force to the wiping cloth using a second wiper blade using a selected force. For yet another example, the processor resource 222 may carry out a set of instructions to select blade pressures by calibrating force applied by the first wiper blade and the second wiper blade via a diagnostics operation executed by the processor resource 222 to compare a realized force to threshold force for each wiper blade. In that example, the controller 200 may have a threshold height or threshold amount of pressure to apply by a wiper blade, compare an actual height and/or threshold amount of pressure of the wiper blade, and make a height adjustment to reduce the difference between the threshold height, or threshold amount of pressure to the actual height and/or threshold amount of pressure.

A processor resource is any appropriate circuitry capable of processing (e.g., computing) instructions, such as one or multiple processing elements capable of retrieving instructions from a memory resource and executing those instructions. For example, the processor resource 222 may be a central processing unit (CPU) that enables positioning of blades of a wiper system by fetching, decoding, and executing the blade module 202. Example processor resources include at least one CPU, a semiconductor-based microprocessor, a programmable logic device (PLD), and the like. Example PLDs include an application specific integrated circuit (ASIC), a field-programmable gate array (FPGA), a programmable array logic (PAL), a complex programmable logic device (CPLD), and an erasable programmable logic device (EPLD). A processor resource may include multiple processing elements that are integrated in a single device or distributed across devices. A processor resource may process the instructions serially, concurrently, or in partial concurrence.

A memory resource represents a medium to store data utilized and/or produced by the system 200. The medium is any non-transitory medium or combination of non-transitory media able to electronically store data, such as modules of the system and/or data used by the system. For example, the medium may be a storage medium, which is distinct from a transitory transmission medium, such as a signal. The medium may be machine-readable, such as computer-readable. The medium may be an electronic, magnetic, optical, or other physical storage device that is capable of containing (i.e., storing) executable instructions. A memory resource may be said to store program instructions that when executed by a processor resource cause the processor resource to implement functionality of the wiper systems described herein. A memory resource may be integrated in the same device as a processor resource or it may be separate but accessible to that device and the processor resource. A memory resource may be distributed across devices.

The controller 200 may be circuitry or a combination of circuitry and executable instructions. Such components may be implemented in a number of fashions. Looking at FIG. 12, the executable instructions may be processor-executable instructions, such as program instructions, stored on the memory resource 220, which is a tangible, non-transitory computer-readable storage medium, and the circuitry may be electronic circuitry, such as processor resource 222, for executing those instructions. The instructions residing on a memory resource may comprise any set of instructions to be executed directly (such as machine code) or indirectly (such as a script) by a processor resource.

Figure 13:
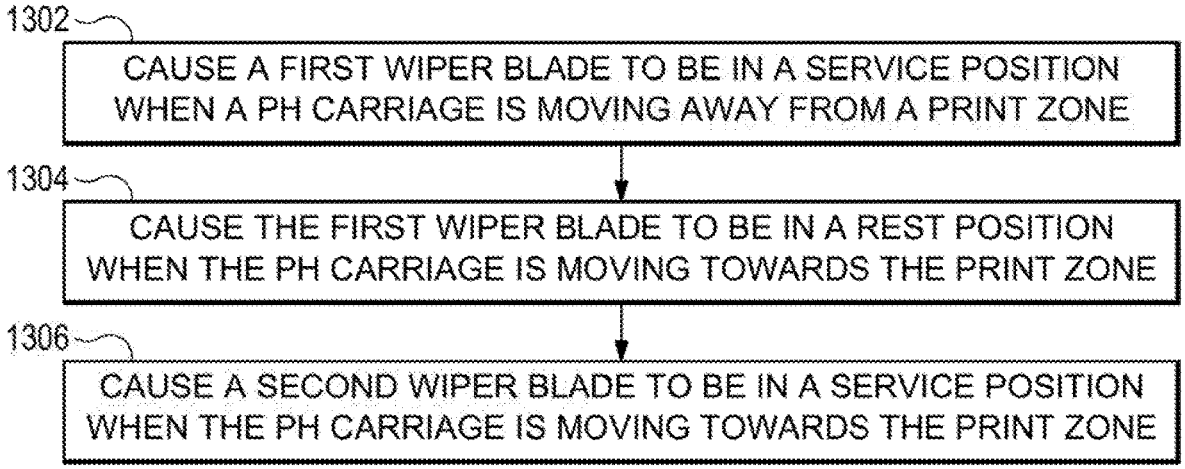
FIGS. 13 and 14 are flow diagrams depicting example methods of operation of wiper blades.
Figure 14:
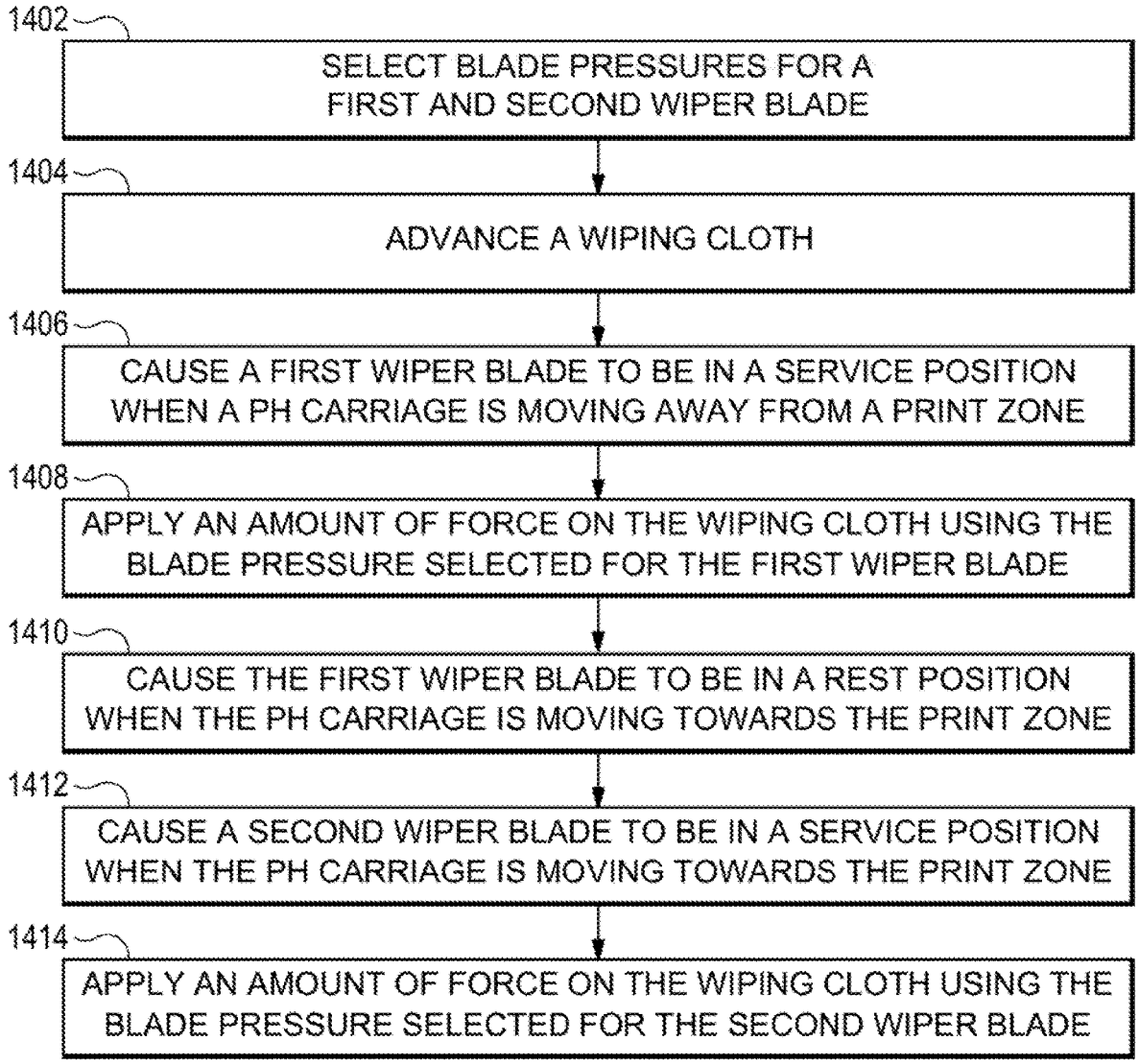

In some examples, the controller 200 may include the executable instructions that may be part of an installation package that when installed may be executed by a processor resource to perform operations of the controller 200, such as methods described with regards to FIGS. 13-14. In that example, a memory resource may be a portable medium such as a compact disc, a digital video disc, a flash drive, or memory maintained by a computer device, such as a print server, from which the installation package may be downloaded and installed. In another example, the executable instructions may be part of an application or applications already installed. A memory resource may be a non-volatile memory resource such as read only memory (ROM), a volatile memory resource such as random access memory (RAM), a storage device, or a combination thereof. Example forms of a memory resource include static RAM (SRAM), dynamic RAM (DRAM), electrically erasable programmable ROM (EEPROM), flash memory, or the like. A memory resource may include integrated memory such as a hard drive (HD), a solid state drive (SSD), or an optical drive.

FIGS. 13 and 14 are flow diagrams depicting example methods of operation of blades of a wiper system. Referring to FIG. 13, example methods of blade operation may generally comprise causing a first wiper blade of a service station to be in a service positon to place force on a wiping cloth when a print head carriage of a print apparatus is moving away from a print zone of the print apparatus, causing the first wiper blade to be in a rest position when the print head carriage is moving towards the print zone, and causing a second wiper blade of the service station to be in a service position when the print head carriage is moving towards the print zone. A controller of the service station, such as controller 200, may execute instructions to cause the print apparatus to perform the methods of FIGS. 13 and 14.

At block 1302 of FIG. 13, the first wiper blade is moved to a service position when a print head carriage is moving away from the print zone of the print apparatus. The first wiper blade may be caused to move into the service position before the print head exits the print zone. For example, the first wiper blade may be in the service position while print head carriage is in the print zone.

At block 1304, the first wiper blade is moved to a rest position when the print head carriage is moving towards the print zone. For example, after the print head carriage passes the first wiper blade (e.g., the first wiper blade performs a service operation on the print head), the print head carriage may pause and then reciprocate back over the service zone at block 1306 and the first wiper blade may drop down to a rest position after the service is performed by the first wiper blade and before the print head carriage is wiped by the second wiper blade in the service position (e.g., at block 1306).

At block 1306, a second wiper blade is moved to a service position when the print head carriage is moving towards the print zone. The second wiper blade may be caused to move into the service position before the print head carriage begins moving toward the print zone.

FIG. 14 includes blocks similar to blocks of FIG. 13 and provides additional blocks and details. In particular, FIG. 14 depicts additional blocks and details generally regarding selecting blade pressures, advancing wiping cloth, and applying force on the wiping cloth based on the blade pressures. Blocks 1406, 1410, and 1412 are the same as blocks 1302, 1304, and 1306 of FIG. 13 and, for brevity, their respective descriptions are not repeated in their entirety.

At block 1402, blade pressures are selected for the first wiper blade and the second wiper blade. For example, a controller may determine an amount of pressure a blade should place on an area of wiping cloth based on the type of service operation to be performed by the particular wiper blade. The blade pressure may be represented as a height of the blade with respect to the print head surface to be cleaned. The blade pressures among the plurality of blades may be different and independent of each other and/or independent of the pass of the print head carriage. For example, the blade pressure placed on the cloth when the print head carriage moves to the right may be different than the blade pressure place on the cloth when the print head carriage moves to the left. For another example, a controller may cause a blade to service with additional or less force than average force of the blade on the cloth based on a pattern (or randomly). In that example, the change in force may enhance the servicing performed on the print head, such as adding additional 0.5 mm height every fifth pass to service crusted nozzles that may have been stuck on after an average wiper height of 2 mm.

In another example, the blade pressures may be identified and selected based on a diagnostics operations. For example, a controller may calibrate force applied by the first wiper blade and the second wiper blade via a diagnostics operation executed by the controller to compare a realized force to a threshold force for each wiper blade. In this manner, the blade pressure may be adjusted to maintain servicing even when the servicing environment changes such as by wear on a wiper blade or changes in the print head to platen spacing when replacing a part.

At block 1404, the wiping cloth is advanced. The wiping cloth may be advanced to move an area of used cloth out of the servicing area and an area of clean, unused cloth into the servicing area. The wiping cloth may be advanced before the first wiper blade moves into the service position (e.g., at the beginning of a set of service operations).

The first wiper blade is caused to move to a service position at block 1406 and an amount of force is applied on the wiping cloth using the blade pressure selected for the first wiper blade at block 1408. With the first force applied on the cloth perpendicular to the print head scanning direction, a print head may make contact with the cloth to perform a first service operation. Once the service operation using the first wiper blade is performed, the first wiper blade is moved to a rest position at block 1410.

The second wiper blade is caused to move to a service position at block 1412 and an amount of force is applied on the wiping cloth using the blade pressure selected for the second wiper blade. With the second force applied on the cloth perpendicular to the print head scanning direction, a print head, may make contact with the cloth to perform a second service operation. Once the second service operation using the second wiper blade is performed, the second wiper blade may be moved to a rest position and both blades may stay in the rest position until another set of service operations are to be performed.

As mentioned with respect to block 1402, the selected blade pressures may be different. For example, an amount of force applied to the wiping cloth using the second wiper blade may be greater than an amount of force applied to the wiping cloth using the first wiper blade. Such amount of pressure may be based on the service operation designated for each wiper blade. In this manner, a print head may be serviced by a wiping system of a service station with various forces on the cloth and/or position of the cloth, which may be focused on removing different types of print fluid from the print head nozzle plate, for example.

Although the flow diagrams of FIGS. 13-14 illustrate specific orders of execution, the order of execution may differ from that which is illustrated. For example, the order of execution of the blocks may be scrambled relative to the order shown. Also, the blocks shown in succession may be executed concurrently or with partial concurrence. All such variations are within the scope of the present description.

All of the features disclosed in this specification (including any accompanying claims, abstract and drawings), and/or all of the elements of any method or process so disclosed, may be combined in any combination, except combinations where at least some of such features and/or elements are mutually exclusive.

The present description has been shown and described with reference to the foregoing examples. It is understood, however, that other forms, details, and examples may be made without departing from the spirit and scope of the following claims. The use of the words "first," "second," or related terms in the claims are not used to limit the claim elements to an order or location, but are merely used to distinguish separate claim elements.

What is claimed is:

1. A wiper system comprising:

a first wiper blade;

a second wiper blade oriented parallel to the first wiper blade; and a cam coupled to the first wiper blade to move the first wiper blade to a first wipe position when the cam is in a first cam position, and the cam coupled to the second wiper blade to move the second wiper blade to a second wipe position when the cam is in a second cam position, wherein the first wipe position has a first interference height relative to a print head carriage, and the second wipe position has a different second interference height relative to the print head carriage, and wherein the first wiper blade at the first wipe position is to apply a first force to clean the print head carriage based on the first interference height, and the second wiper blade at the second wipe position is to apply a different second force to clean the print head carriage based on the second interference height.

2. The wiper system of claim 1, wherein:

the cam is rotatable to angles that correspond to the first cam position and the second cam position, and the cam is rotatable to a third cam position where both the first wiper blade and the second wiper blade are in a rest position.

3. The wiper system of claim 1, comprising:

a cloth advance mechanism to move a cloth over the first wiper blade and the second wiper blade.

4. The wiper system of claim 3, wherein the first wiper blade is to apply the first force against the cloth, and the second wiper blade is to apply the second force against the cloth.

5. The wiper system of claim 4, wherein the first force is perpendicular to an advance motion of the cloth, and the second force is perpendicular to an advance motion of the cloth.

6. The wiper system of claim 1, wherein the first wiper blade and the second wiper blade are made of different materials with different compression attributes.

7. The wiper system of claim 1, wherein:

each of the first wiper blade and the second wiper blade has a combination of a shape, a thickness, and a material that produces linear deformation, and the cam is coupled to a shaft having a corresponding cam at a distal end of the shaft.

8. The wiper system of claim 1, wherein the cam is rotatable to lift the first wiper blade or the second wiper blade to a selected height of the first interference height or the second interference height.

9. The wiper system of claim 8, wherein an amount of the lift has a linear relationship with an angle of the cam.

10. A wiper system comprising:

a first wiper blade;

a second wiper blade oriented parallel to the first wiper blade;

a cam coupled to the first wiper blade to move the first wiper blade to a first wipe position when the cam is in a first cam position, and the cam coupled to the second wiper blade to move the second wiper blade to a second wipe position when the cam is in a second cam position;

a gear system coupled to the cam;

a motor coupled to the gear system, the motor to rotate the cam to angles corresponding to the first cam position and the second cam position;

a first set of plates coupled to the first wiper blade, the first set of plates to move the first wiper blade to the first wipe position when the cam is rotated to an angle corresponding to the first cam position;

a second set of plates coupled to the second wiper blade, the second set of plates to move the second wiper blade to the second wipe position when the cam is rotated to an angle corresponding to the second cam position; and a shaft to which the cam is fixedly coupled, the cam to rotate as the shaft rotates.

11. The wiper system of claim 10, comprising:

a controller coupled to the motor to control rotation of the cam to an angle based on a print head scanning location.

12. The wiper system of claim 10, wherein the cam is a first cam, and the wiper system further comprises:

a second cam fixedly coupled to the shaft, wherein the first cam and the second cam are to rotate together as the shaft rotates.

13. The wiper system of claim 10, further comprising an advance system to advance a web material along an advance path, the first wiper blade and the second wiper blade to engage the web material to clean a print head carriage.

14. The wiper system of claim 13, wherein the first wipe position has a first interference height relative to the print head carriage, and the second wipe position has a different second interference height relative to the print head carriage, and wherein the first wiper blade at the first wipe position is to apply a first force against the web material to clean the print head carriage based on the first interference height, and the second wiper blade at the second wipe position is to apply a different second force against the web material to clean the print head carriage based on the second interference height.

15. The wiper system of claim 10, wherein the first wipe position has a first interference height relative to the print head carriage, and the second wipe position has a different second interference height relative to the print head carriage, and wherein the first wiper blade at the first wipe position is to apply a first force to clean the print head carriage based on the first interference height, and the second wiper blade at the second wipe position is to apply a different second force to clean the print head carriage based on the second interference height.

16. A non-transitory computer-readable storage medium comprising instructions executable by a processor resource to:

cause a first wiper blade of a service station to be in a first service position that places force on a wiping cloth when a print head carriage of a print apparatus is moving away from a print zone of the print apparatus;

cause the first wiper blade to be in a rest position when the print head carriage is moving towards the print zone;

cause a second wiper blade of the service station to be in a second service position that places force on the wiping cloth when the print head carriage is moving towards the print zone, wherein an amount of the force to the wiping cloth placed by the second wiper blade in the second service position is greater than an amount of the force to the wiping cloth placed by the first wiper blade in the first service position; and control an advance of the wiping cloth before the first wiper blade moves into the first service position.

17. The non-transitory computer-readable storage medium of claim 16, wherein the instructions are executable by the processor resource to:

cause the first wiper blade to move into the first service position before the print head carriage exits the print zone; and cause the second wiper blade to move into the second service position before the print head carriage begins moving toward the print zone.

18. The non-transitory computer-readable storage medium of claim 16, wherein the instructions are executable by the processor resource to:

select different blade pressures independently at each pass of the print head carriage.

19. The non-transitory computer-readable storage medium of claim 16, wherein the instructions are executable by the processor resource to:

calibrate forces applied by the first wiper blade and the second wiper blade via a diagnostics operation executed by the processor resource to compare a realized force to a threshold force for each wiper blade of the first wiper blade and the second wiper blade.

* * * * *